US011688946B2

(12) United States Patent
Kobuke et al.

(10) Patent No.: US 11,688,946 B2
(45) Date of Patent: Jun. 27, 2023

(54) ANTENNA DEVICE, COMMUNICATION APPARATUS HAVING THE SAME, AND MANUFACTURING METHOD OF ANTENNA DEVICE

(71) Applicant: TDK Corporation, Tokyo (JP)

(72) Inventors: Hisashi Kobuke, Tokyo (JP); Yasumasa Harihara, Tokyo (JP); Kenichi Tezuka, Tokyo (JP); Tomoyuki Goi, Tokyo (JP)

(73) Assignee: TDK CORPORATION, Tokyo (JP)

( * ) Notice: Subject to any disclaimer, the term of this patent is extended or adjusted under 35 U.S.C. 154(b) by 146 days.

(21) Appl. No.: 17/472,192

(22) Filed: Sep. 10, 2021

(65) Prior Publication Data

US 2022/0085508 A1 Mar. 17, 2022

(30) Foreign Application Priority Data

Sep. 14, 2020 (JP) ..... JP2020-154124

(51) Int. Cl.
*H01Q 9/04* (2006.01)

(52) U.S. Cl.
CPC ..... *H01Q 9/045* (2013.01)

(58) Field of Classification Search
None
See application file for complete search history.

(56) References Cited

U.S. PATENT DOCUMENTS

| | | | | |
|---|---|---|---|---|
| 11,211,697 | B2 * | 12/2021 | Yun | H01Q 9/0442 |
| 2018/0006358 | A1 * | 1/2018 | Gottwald | H01Q 1/2283 |
| 2019/0379134 | A1 * | 12/2019 | Paulotto | H01Q 21/062 |
| 2020/0364532 | A1 * | 11/2020 | Herslow | H01Q 1/2225 |
| 2021/0320421 | A1 * | 10/2021 | Cho | H01Q 1/2283 |
| 2021/0328351 | A1 * | 10/2021 | Avser | H01Q 1/243 |
| 2021/0391651 | A1 * | 12/2021 | Hasnat | H01Q 13/22 |

FOREIGN PATENT DOCUMENTS

JP 2019-004241 A 1/2019

* cited by examiner

*Primary Examiner* — Wilson Lee
(74) *Attorney, Agent, or Firm* — McDermott Will & Emery LLP

(57) ABSTRACT

An antenna device according to the present disclosure includes two wiring layers and an antenna layer. One of the two wiring layers is divided in the x-direction by a first slit extending in the y-direction, and the antenna layer is divided in the x-direction into first and second antenna areas by a second slit extending in the y-direction. The first and second slits overlap each other in the z-direction. One of the first and second slits is larger in width than the other one thereof. The antenna layer includes an antenna conductor formed in the first antenna area and another antenna conductor formed in the second antenna area.

12 Claims, 9 Drawing Sheets

ANTENNA DEVICE, COMMUNICATION APPARATUS HAVING THE SAME, AND MANUFACTURING METHOD OF ANTENNA DEVICE

BACKGROUND

Field

The present disclosure relates to an antenna device and a communication device having the same and, more particularly, to an antenna device capable of emitting beams in a plurality of directions and a communication device having the same. The present disclosure relates also to a manufacturing method for such an antenna device.

Description of Related Art

JP 2019-004241A discloses an antenna device capable of emitting beams in a plurality of directions. The antenna device disclosed in this document has a flexible substrate which is configured to be foldable along a part thereof with a smaller thickness to allow a plurality of antenna conductors to be directed in mutually different directions.

To mitigate stress applied to the flexible substrate when it is folded in the above disclosed antenna device, it is necessary to ensure a sufficient width for the smaller thickness part. However, an increase in the width of the small thickness part lowers the use efficiency of the substrate and disadvantageously increases the height of the entire antenna device when being folded.

SUMMARY

It is therefore an object of the present disclosure to provide an antenna device capable of emitting beams in a plurality of directions, in which the use efficiency of a substrate constituting the antenna device is improved, and the height of the entire antenna device when it is being folded is minimized and a communication device having such an antenna device. Another object of the present disclosure is to provide a manufacturing method for such an antenna device.

An antenna device according to the present disclosure includes an antenna layer having a plurality of antenna conductors and a first wiring layer stacked on the antenna layer and having a plurality of wiring patterns. The antenna layer has first and second antenna areas which are obtained by dividing, by a slit extending in a first planar direction perpendicular to the stacking direction, the antenna layer in a second planar direction perpendicular to the stacking direction and first planar direction. The slit is enlarged in width in the second planar direction at its bottom contacting the first wiring layer. The plurality of antenna conductors include a first antenna conductor formed in the first antenna area and a second antenna conductor formed in the second antenna area.

DETAILED DESCRIPTION OF THE EMBODIMENTS

Hereinafter, preferred embodiments of the present disclosure will be described in detail with reference to the accompanying drawings.

First Embodiment

Figure 1:
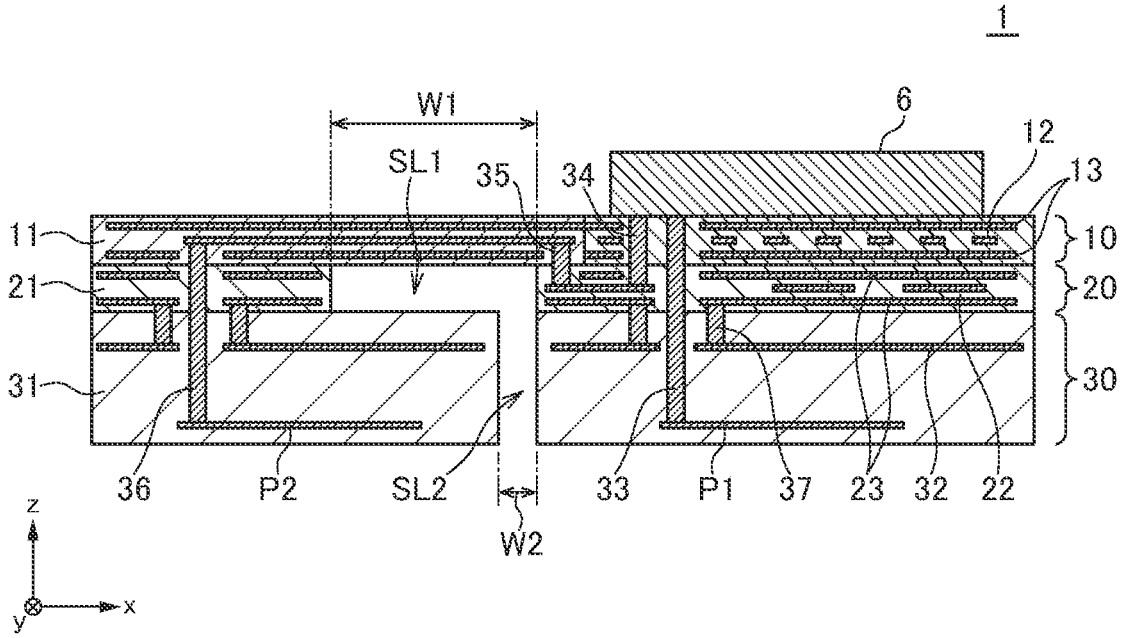
FIG. 1 is a schematic cross-sectional view for explaining the structure of an antenna device 1 according to a first embodiment of the present disclosure.
Figure 2:
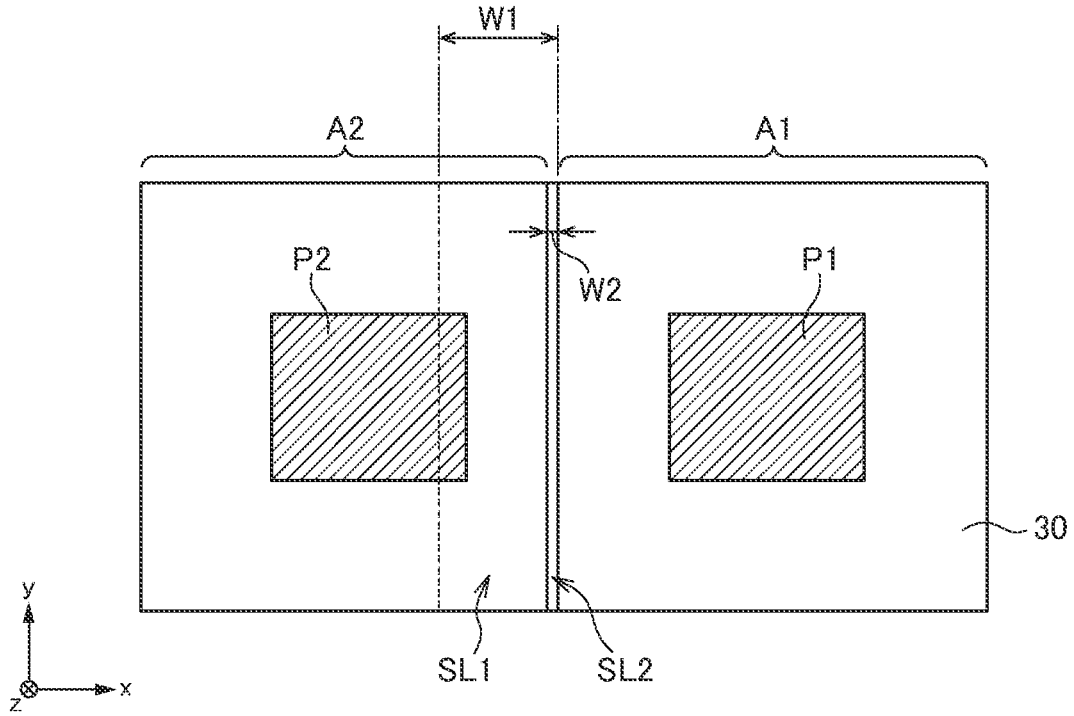
FIG. 2 is a schematic plan view of the antenna device 1.

FIG. 1 is a schematic cross-sectional view for explaining the structure of an antenna device 1 according to a first embodiment of the present disclosure. FIG. 2 is a schematic plan view of the antenna device 1.

As illustrated in FIGS. 1 and 2, the antenna device 1 according to the present embodiment has wiring layers 10, 20 and an antenna layer 30, and a semiconductor IC 6 is mounted on the surface of the wiring layer 10.

The wiring layer 10 has a plurality of flexible insulating layers 11 and a plurality of wiring patterns 12 formed on the surfaces of the insulating layers 11. The wiring patterns 12 include a power supply pattern and a control signal pattern which are connected to the semiconductor IC 6. The wiring patterns 12 are sandwiched between ground patterns 13 in the z-direction so as to be shielded.

The wiring layer 20 is positioned between the wiring layer 10 and the antenna layer 30 in the z-direction and has a plurality of insulating layers 21 and a plurality of RF signal patterns 22 formed on the surfaces of the insulating layers 21. The RF signal patterns 22 constitute a circuit such as a filter and are connected to antenna conductors P1 and P2 included in the antenna layer 30. The RF signal patterns 22 are sandwiched between ground patterns 23 in the z-direction so as to be shielded.

The antenna layer 30 includes a plurality of insulating layers 31 and antenna conductors P1, P2 and a ground pattern 32 which are formed on the surfaces of the insulating layers 31. The antenna conductors P1 and P2 each have the xy plane and each overlap the ground pattern 32 to constitute a patch antenna. The antenna conductor P1 is connected to the semiconductor IC 6 through a via conductor 33, and the antenna conductor P2 is connected to the semiconductor IC 6 through via conductors 34 to 36.

As illustrated in FIGS. 1 and 2, the wiring layer 20 has a slit SL1 extending in the y-direction. The slit SL1 extends in the y-direction by the length equal to the length of the wiring layer 20 in the y-direction to thereby divide the wiring layer 20 in the x-direction. The width of the slit SL1 in the x-direction is W1. The height of the slit SL1 in the z-direction is equal to the height of the wiring layer 20 in the z-direction. Although the slit SL1 is preferably formed to be hollow, a filler may be filled in a part of or over the entirety of the slit SL1. In this case, the filler existing in the slit SL1 needs to be a material having low adhesion to the wiring layer 10 and antenna layer 30.

Similarly, the antenna layer 30 has a slit SL2 extending in the y-direction. The slit SL2 extends in the y-direction by the length equal to the length of the antenna layer 30 in the y-direction to thereby divide the antenna layer 30 into antenna areas A1 and A2 in the x-direction. The width of the slit SL2 in the x-direction is W2 which is smaller than the width W1 of the slit SL1. The height of the slit SL2 in the z-direction is equal to the height of the antenna layer 30 in the z-direction.

The slits SL1 and SL2 overlap each other in the z-direction. In the example illustrated in FIGS. 1 and 2, one end portion of the slit SL1 in the x-direction and the slit SL2 overlap each other. The antenna areas A1 and A2 defined by the slit SL2 have the antenna conductors P1 and P2, respectively. The antenna conductor P2 partially overlaps the slit SL1 in the z-direction.

Figure 3:
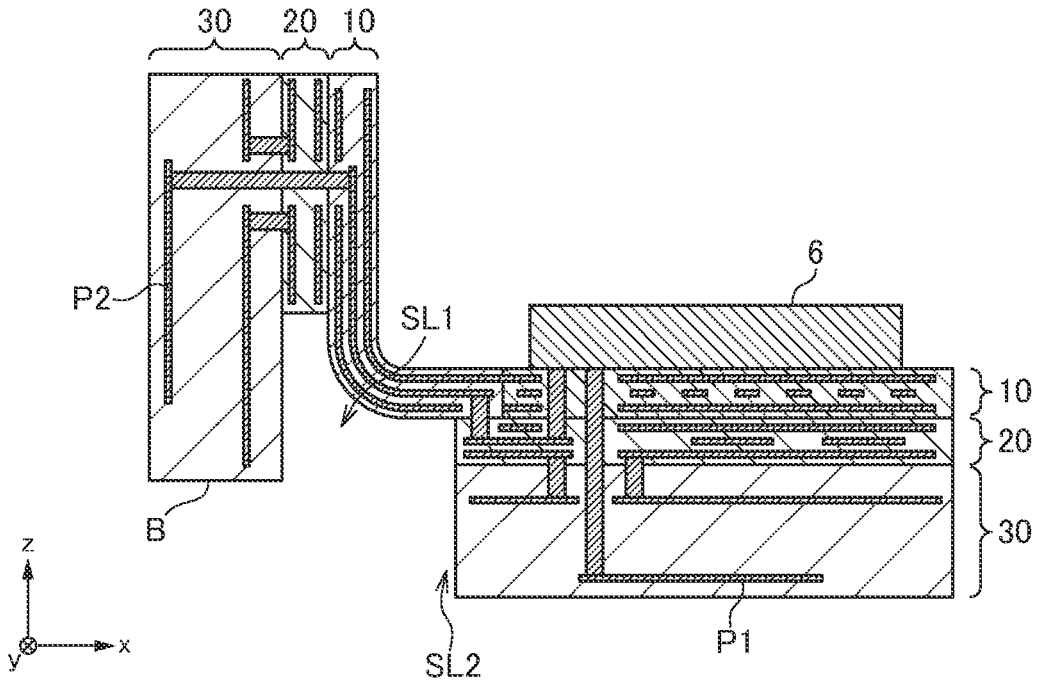
FIG. 3 is a schematic cross-sectional view illustrating a state where the antenna device 1 is folded.

In the thus configured antenna device 1 according to the present embodiment, the wiring layer 10 can be folded along the slits SL1 and SL2. In the example illustrated in FIG. 3, the wiring layer 10 is folded by 90°, whereby the antenna conductors P1 and P2 are directed in directions mutually different by 90°. Specifically, the beam emitting direction of the antenna conductor P1 is the z-direction, while the beam emitting direction of the antenna conductor P2 is the x-direction. By making the width W1 of the slit SL1 sufficiently large, a surface B, which constitutes the inner wall of the slit SL2, can be flush with the bottom surface of the antenna layer 30 when the wiring layer 10 is folded.

The wiring layer 10 can be folded even when the widths W1 and W2 of the slits SL1 and SL2 are equal to each other; however, when the width W1 of the slit SL1 is reduced to be equal to the width W2 of the slit SL2, a high stress is applied to the folded part of the wiring layer 10, which in some case causes cracking or rupture in the insulating layer 11 and wiring pattern 12. To mitigate the stress applied to the folded part of the wiring layer 10, the curvature radius of the folded part needs to be set somewhat large, and to achieve this, the width W1 of the slit SL1 is made larger. On the other hand, when the width W2 of the slit SL2 is increased to be equal to the width W1 of the slit SL1, the effective area of the antenna area A2 is disadvantageously reduced, so that the width W2 of the sit SL2 is set smaller than the width W1 of the slit SL1.

As described above, according to the present embodiment, folding the wiring layer 10 along the slits SL1 and SL2 allows the antenna device 1 to emit beams in a plurality of directions. Further, since the width W2 of the slit SL2 is smaller than the width W1 of the slit SL1, it is possible to increase the use efficiency of the antenna area A2 and to suppress increase in the height of the entire antenna device 1 when being folded. In particular, since the antenna conductor P2 and the slit SL1 overlap each other, the entire planar size can be significantly reduced. However, the overlap between the antenna conductor and the slit is not essential in the present disclosure. That is, a sufficient manufacturing margin can be maintained by reducing the width W2 of the slit SL2, so that the entire planar size can be reduced even when the antenna conductor and the slit do not overlap each other.

Figure 4:
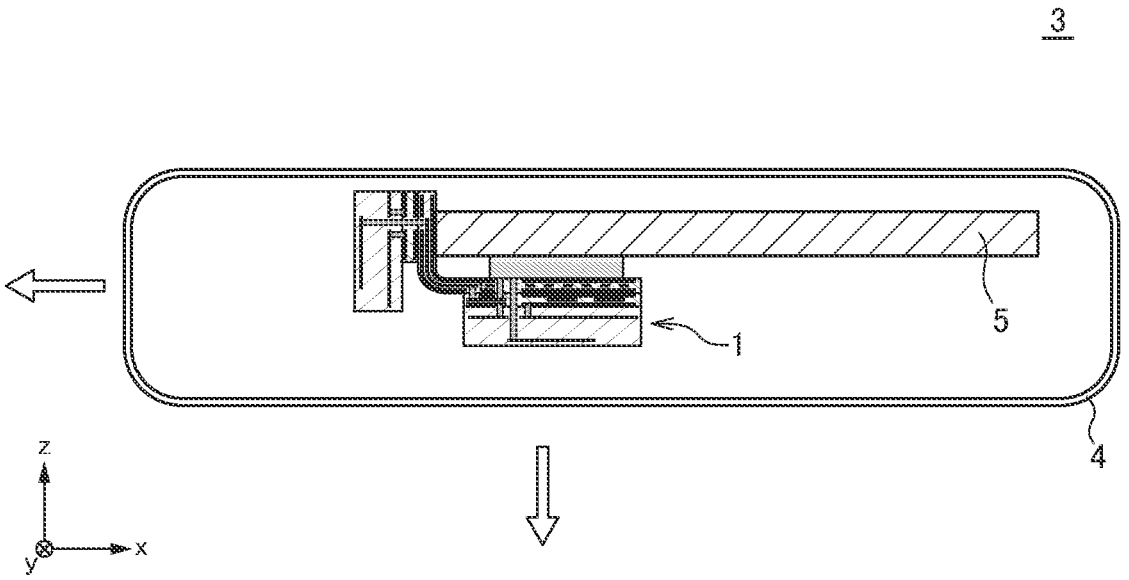
FIG. 4 is a schematic view of a communication device 3 having the antenna device 1.

FIG. 4 is a schematic view of a communication device 3 having the antenna device 1 according to the present embodiment. The communication device 3 illustrated in FIG. 4 is, e.g., a smartphone and includes a substrate 5 housed in a casing 4 and the antenna device 1 mounted on the substrate 5. The antenna device 1 is mounted in a folded state on the substrate 5, thereby allowing beams to be emitted in two directions by the single antenna device 1. In the example illustrated in FIG. 4, a mold resin covering the semiconductor IC6 and the main surface of the substrate 5 are bonded to each other, and the surface of the folded wiring layer 10 and the side surface of the substrate 5 are bonded to each other.

The following describes a manufacturing method for the antenna device 1 according to the present embodiment.

Figure 5:
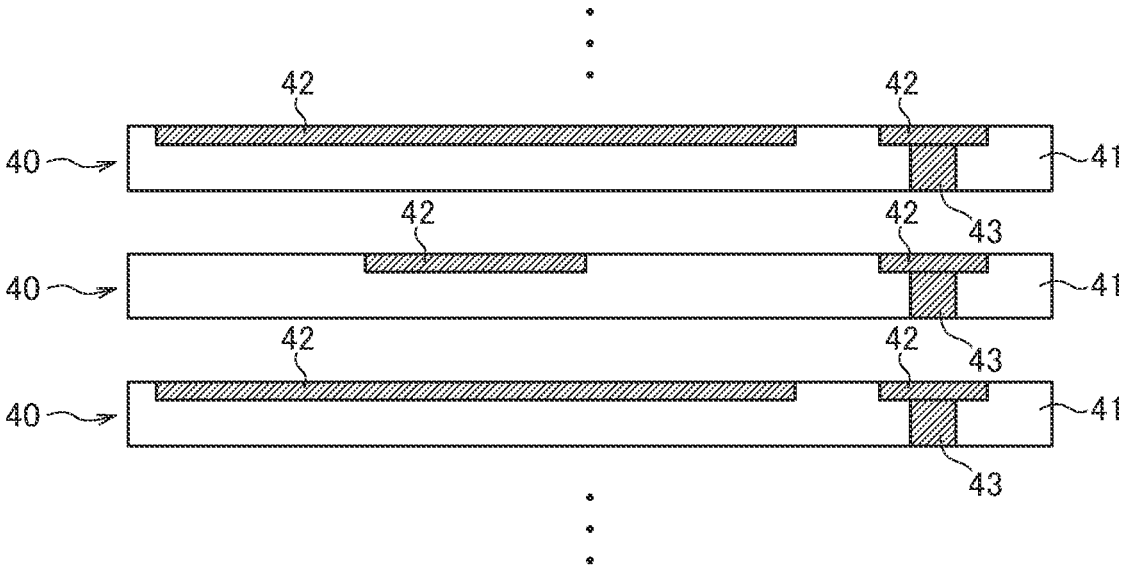
FIGS. 5 to 8 are schematic views for explaining a manufacturing method for the antenna device 1.

First, as illustrated in FIG. 5, a plurality of sheet materials 40 are prepared and sequentially stacked on one another. The sheet materials 40 each have an insulating layer 41, a conductor pattern 42 formed on the surface of the insulating layer 41, and a via conductor 43 penetrating the insulating layer 41. The structures of the sheet materials 40 of FIG. 5 are only illustrative, and there are used sheet materials 40 having structures corresponding to the antenna device 1 to be actually fabricated. The stacking order of the sheet materials 40 is not particularly limited. That is, the sheet materials 40 may be stacked in the order of the wiring layer 10, wiring layer 20, and antenna layer 30, or conversely, in the order of antenna layer 30, wiring layer 20, and wiring layer 10.

Figure 6:
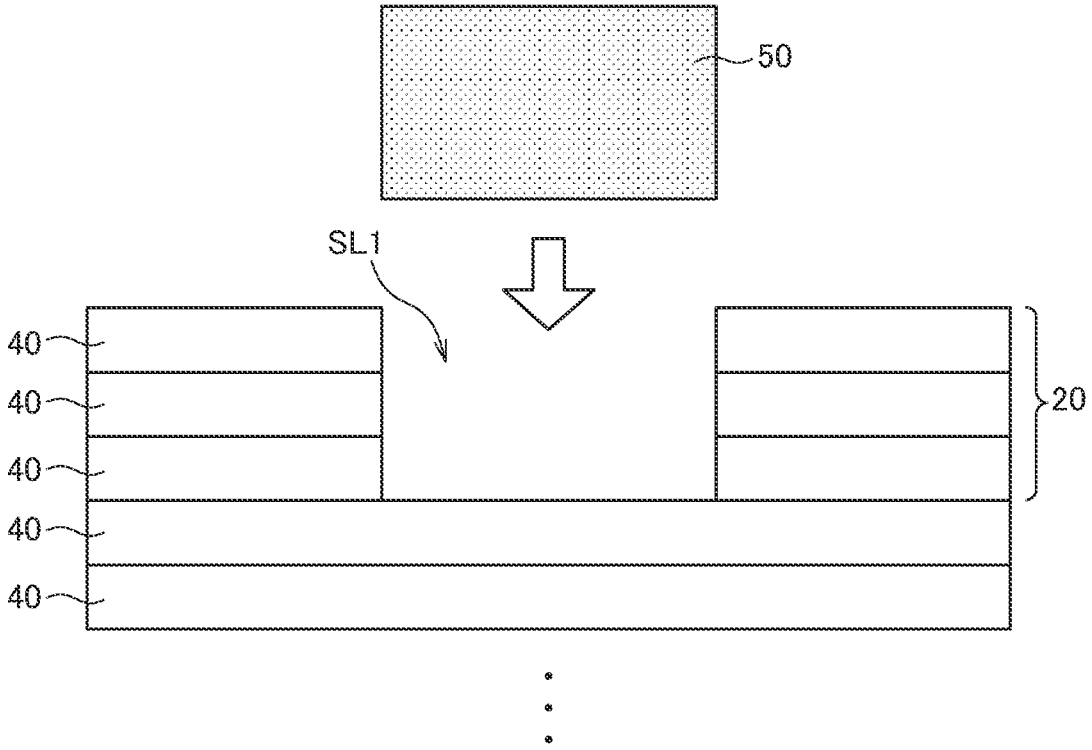
Figure 7:
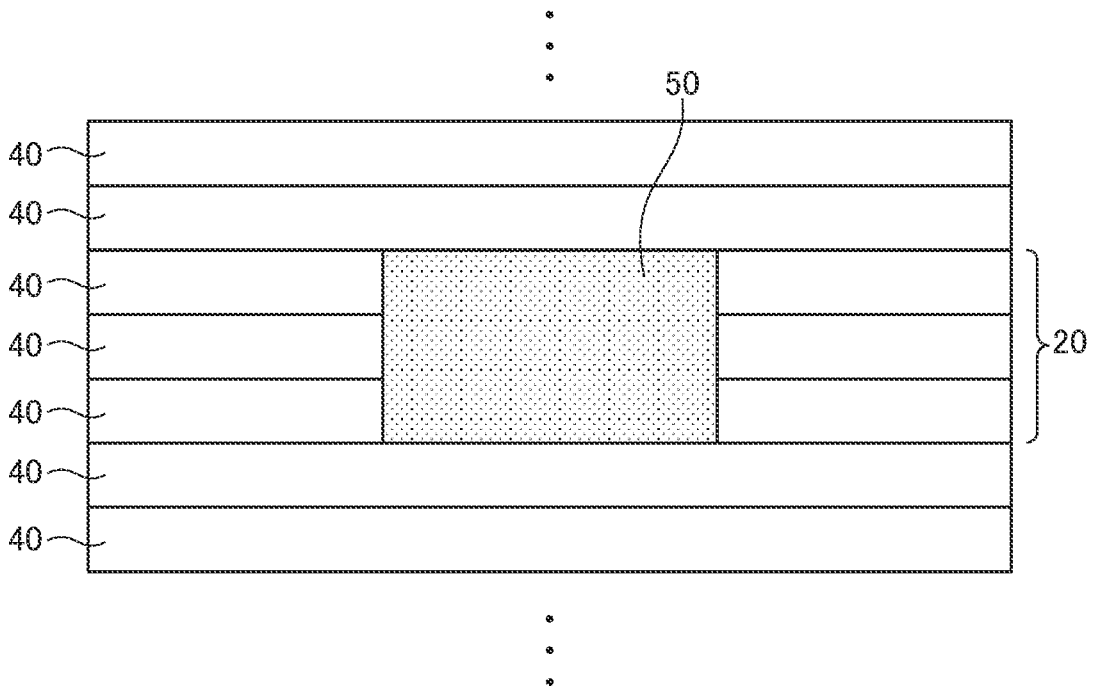

The sheet materials 40 constituting the wiring layer 20 are provided with the slit SL as illustrated in FIG. 6. After the plurality of sheet materials 40 constituting the wiring layer 20 are stacked, a filler 50 may be filled in the slit SL1. Although the filling of the filler 50 in the slit SL1 is not essential in the present disclosure, using the filler 50 makes it possible to stack the sheet materials 40 while maintaining flatness as illustrated in FIG. 7. Examples of the filler 50 include a material having low adhesion to the sheet material 40, such as fluorine-based resin or powder and metal (Cu, etc.) formed by electrolytic plating.

Figure 8:
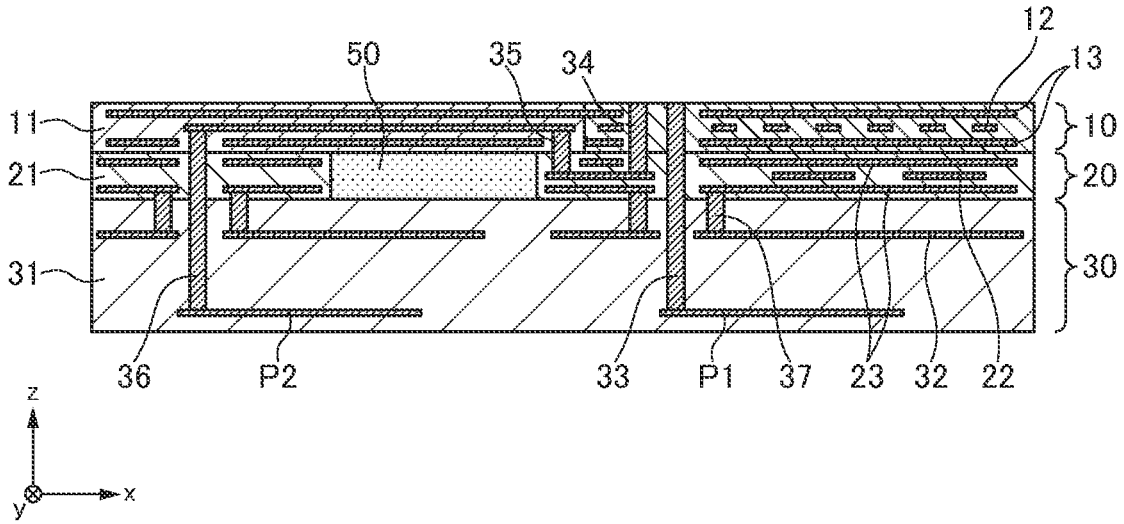

After the formation of the wiring layers 10, 20 and antenna layer 30 constituted by the plurality of sheet materials 40, the slit SL2 is formed at a position overlapping the slit SL1, as illustrated in FIG. 8. The slit SL2 can be formed by laser machining or dicing. This exposes a part of the filler 50 filled in the slit SL1. Then, the filler 50 is removed through the slit SL2, and the semiconductor IC 6 is mounted on the wiring layer 10, whereby the antenna device 1 according to the present embodiment is completed.

When the filler 50 is made of fluorine-based resin or powder, it may be removed through the slit SL2 that has been enlarged by folding the antenna device 1 along the slits SL1 and SL2. When the filler 50 is made of metal such as copper (Cu), it may be removed by wet etching.

Second Embodiment

Figure 9:
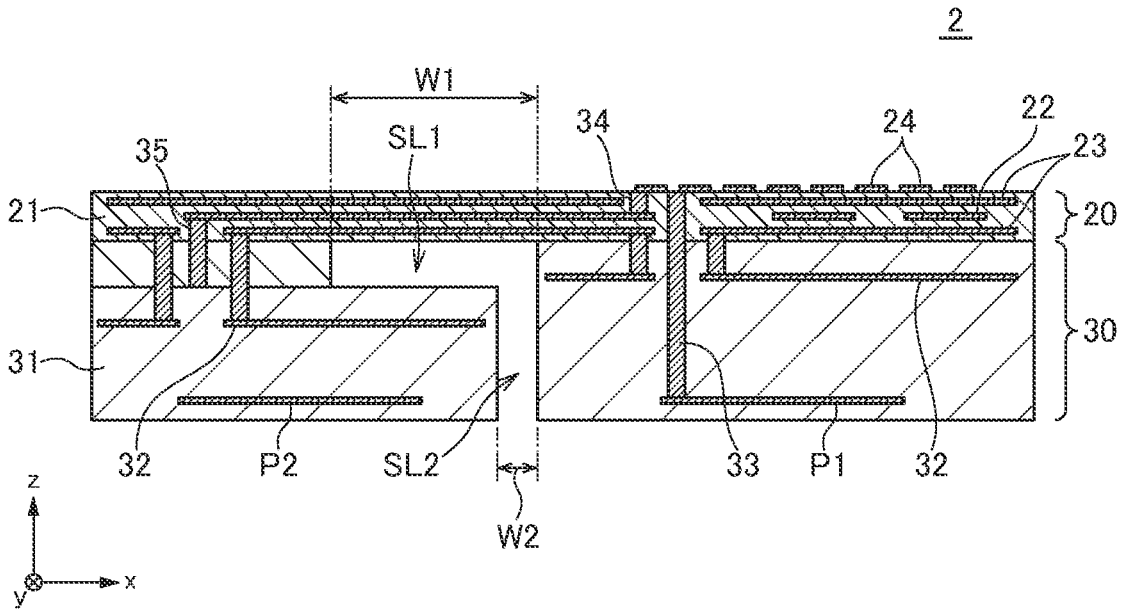
FIG. 9 is a schematic cross-sectional view for explaining the structure of an antenna device 2 according to a second embodiment of the present disclosure.

FIG. 9 is a schematic cross-sectional view for explaining the structure of an antenna device 2 according to a second embodiment of the present disclosure.

As illustrated in FIG. 9, the antenna device 2 according to the present embodiment differs from the antenna device 1 according to the first embodiment in that the wiring layer 10 and the semiconductor IC 6 mounted thereon are omitted and that the slit SL1 is formed at the bottom of the antenna layer 30. Other basic configurations are the same as those of the antenna device 1 according to the first embodiment, so the same reference numerals are given to the same elements, and overlapping description will be omitted.

In the present embodiment, a plurality of terminal electrodes 24 are provided on the surface of the wiring layer 20. The terminal electrodes 24 are provided at positions not overlapping the slits SL1 and SL2 and are connected to land patterns on the substrate 5 illustrated in FIG. 4. In this case, the semiconductor IC 6 is mounted on the substrate 5.

As exemplified by the antenna device 2 according to the second embodiment, it is possible that the entire slit is formed in the antenna layer 30 and that a part obtained by enlarging the width of the slit in the x-direction at its bottom contacting the wiring layer 20 is used as the slit SL1.

Modifications

FIGS. 10 to 14 are schematic plan views illustrating the configurations of respective antenna devices 1A to 1E according to first to fifth modifications.

Figure 10:
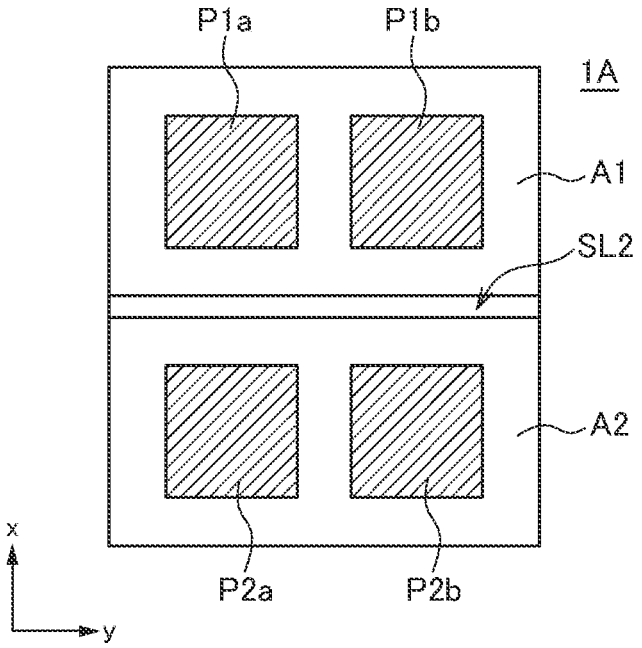
FIG. 10 is a schematic plan view illustrating the configuration of an antenna device 1A according to a first modification.
Figure 11:
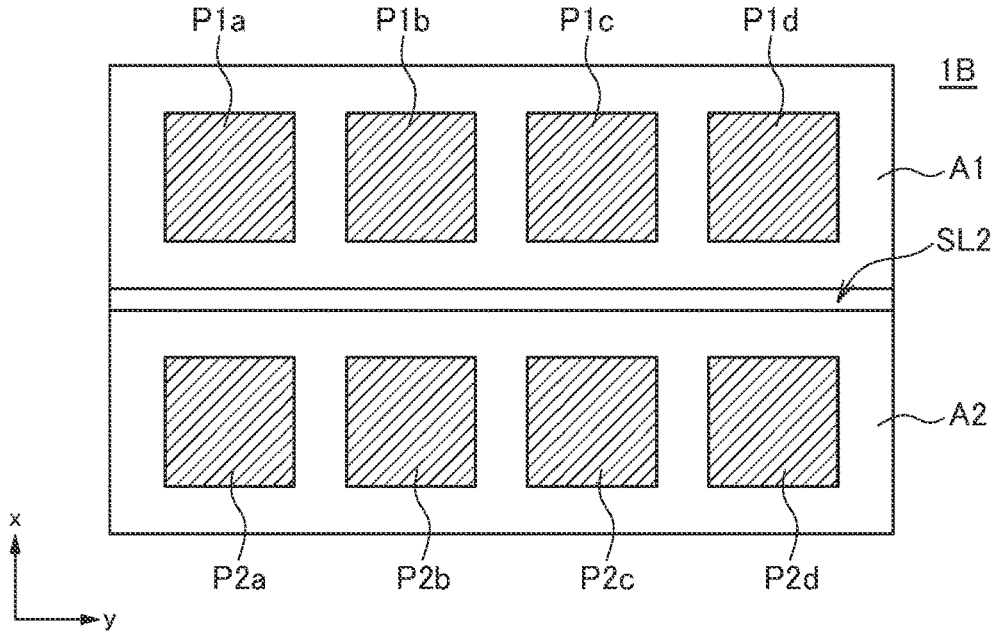
FIG. 11 is a schematic plan view illustrating the configuration of an antenna device 1B according to a second modification.

In the antenna device 1A illustrated in FIG. 10, two antenna conductors P1a and P1b are provided in the antenna area A1, and two antenna conductors P2a and P2b are provided in the antenna area A2. In the antenna device 1B illustrated in FIG. 11, four antenna conductors P1a to P1d are provided in the antenna area A1, and four antenna conductors P2a to P2d are provided in the antenna area A2. Thus, the number of the antenna conductors to be provided in one antenna area is not particularly limited.

Figure 12:
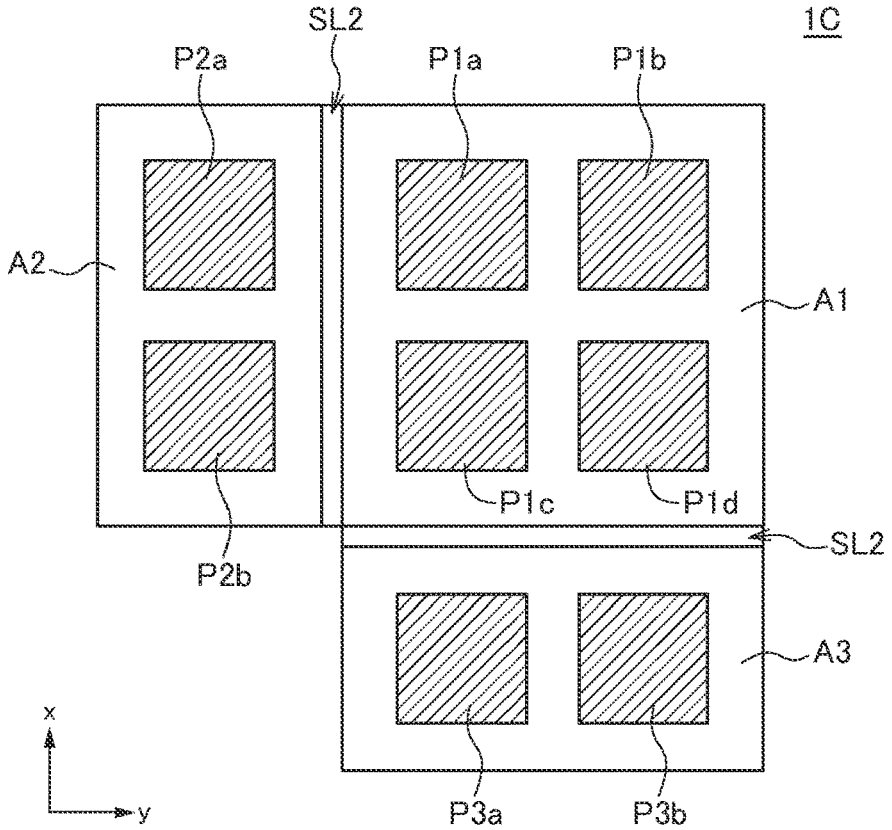
FIG. 12 is a schematic plan view illustrating the configuration of an antenna device 1C according to a third modification.

The antenna device 1C illustrated in FIG. 12 has three antenna areas A1 to A3 obtained by dividing the antenna layer 30 by the slits SL2, in which four antenna conductors P1a to P1d are provided in the antenna area A1, two antenna conductors P2a and P2b are provided in the antenna area A2, and two antenna conductors Pia and P3b are provided in the antenna area A3. The slit SL2 defining the antenna areas A1 and A2 extends in the x-direction, and the slit SL2 defining the antenna areas A1 and A3 extends in the y-direction. Thus, the antenna device 1C can emit beams in three directions when being folded along the slits SL2.

Figure 13:
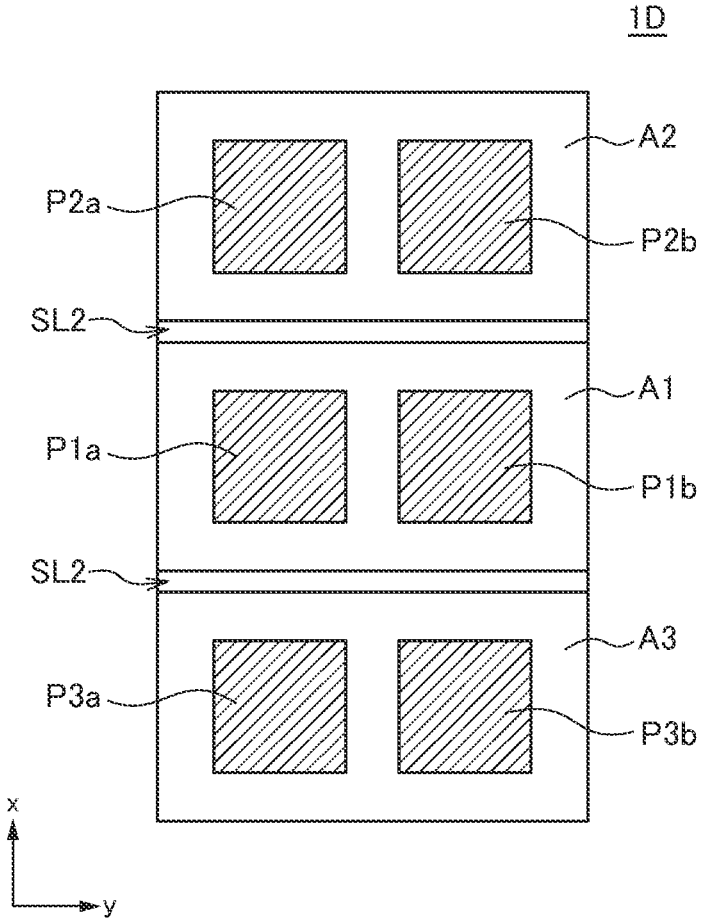
FIG. 13 is a schematic plan view illustrating the configuration of an antenna device 1D according to a fourth modification.

The antenna device 1D illustrated in FIG. 13 has three antenna areas A1 to A3 obtained by dividing the antenna layer 30 by the slits SL2, in which two antenna conductors P1a and P1b, two antenna conductors P2a and P2b, and two antenna conductors P3a and P3b are provided in the antenna areas A1 to A3, respectively. The slit SL2 defining the antenna areas A1 and A2 extends in the y-direction, and the slit SL2 defining the antenna areas A1 and A3 also extends in the y-direction. Thus, the antenna device 1D can emit beams in three directions when being folded along the slits SL2. The directions of the beams emitted from the antenna areas A2 and A3 differ by 180°.

Figure 14:
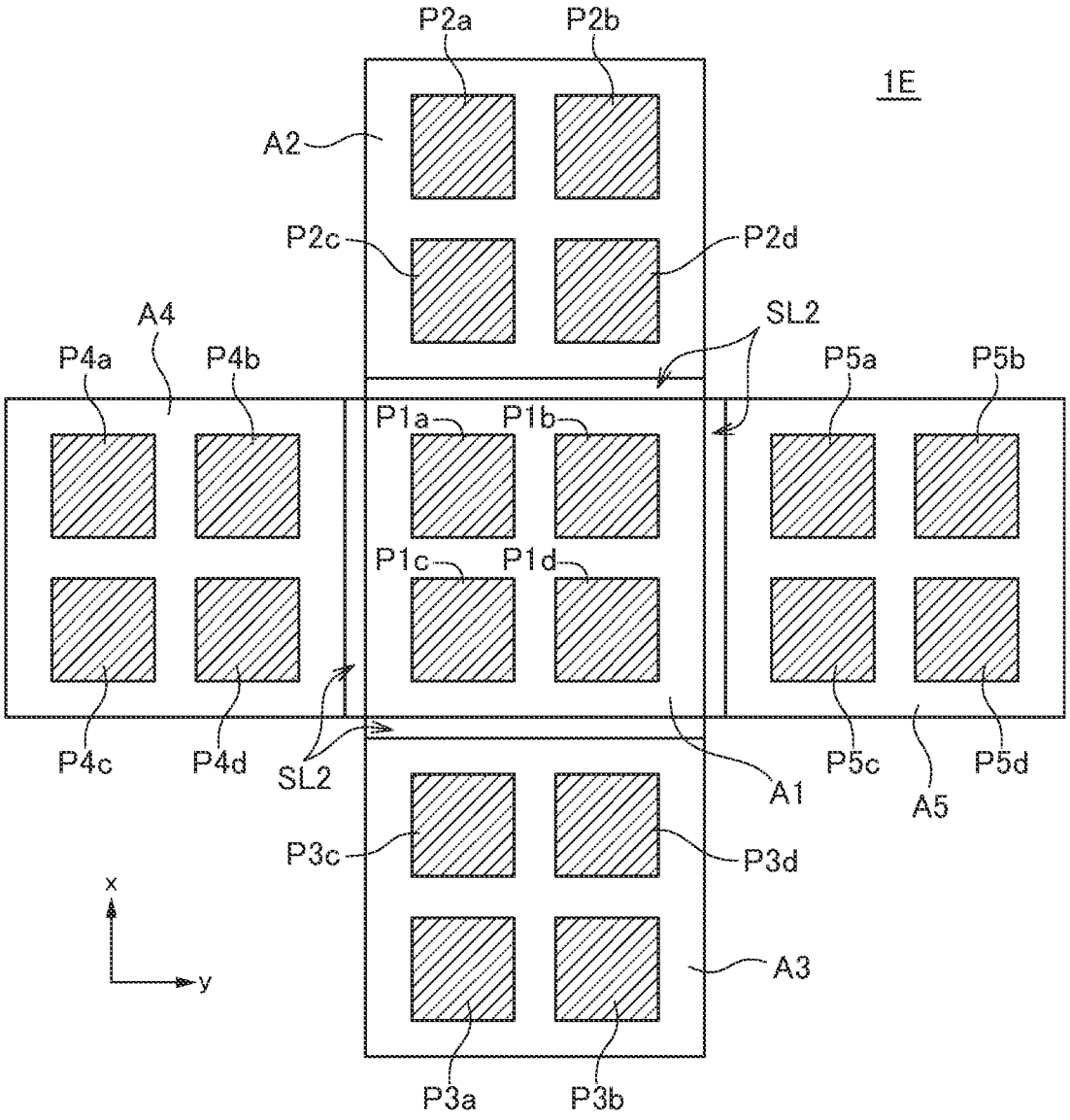
FIG. 14 is a schematic plan view illustrating the configuration of an antenna device 1E according to a fifth modification.

The antenna device 1E illustrated in FIG. 14 has five antenna areas A1 to A5 obtained by dividing the antenna layer 30 by the slits SL2, in which four antenna conductors P1a to P1d, four antenna conductors P2a to P2d, four antenna conductors P3a to P3d, four antenna conductors P4a to P4d, and four antenna conductors P5a to P5d are provided in the antenna areas A1 to A5, respectively. The slits SL2 separating the antenna area A1 from the antenna areas A2 and A3 extend in the y-direction, and the slits SL2 separating the antenna area A1 from the antenna areas A4 and A5 extend in the x-direction. Thus, the antenna device 1E can emit beams in five directions when being folded along the slits SL2. The directions of the beams emitted from the antenna areas A2 and A3 differ by 180°, and the directions of the beams emitted from the antenna areas A4 and A5 differ by 180°.

Figure 15:
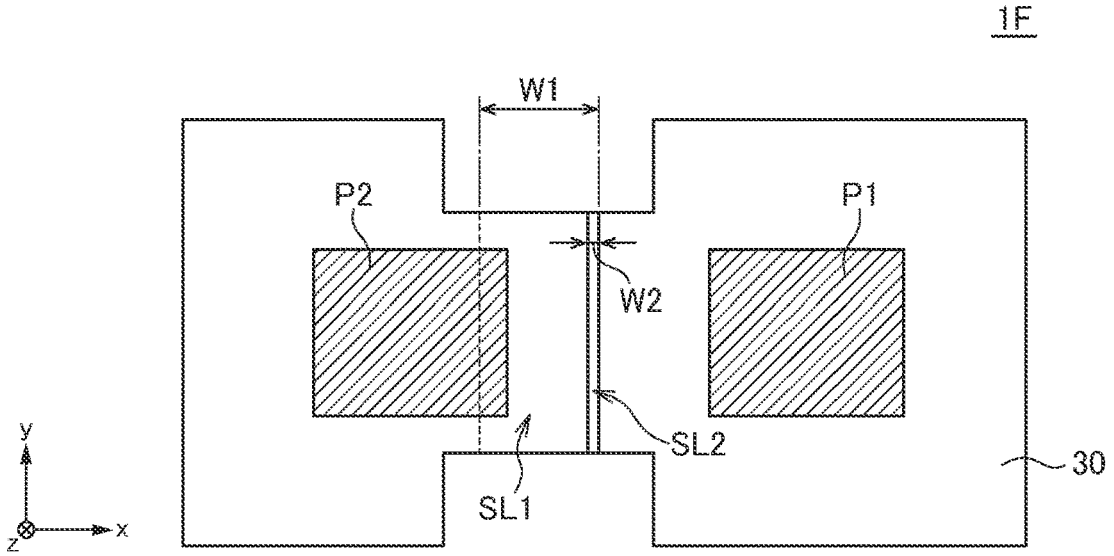
FIG. 15 is a schematic plan view illustrating the configuration of an antenna device 1F according to a sixth modification.

FIG. 15 is a schematic plan view illustrating the configuration of an antenna device 1F according to a six modification. The antenna device 15F illustrated in FIG. 15 differs from the antenna device 1 according to the first embodiment in that the width of a substrate constituting the antenna device 1F in the y-direction is reduced at a portion where the slits SL1 and SL2 are provided and in the vicinity thereof. This makes it easier to fold the substrate along the slits SL1 and SL2.

Figure 16:
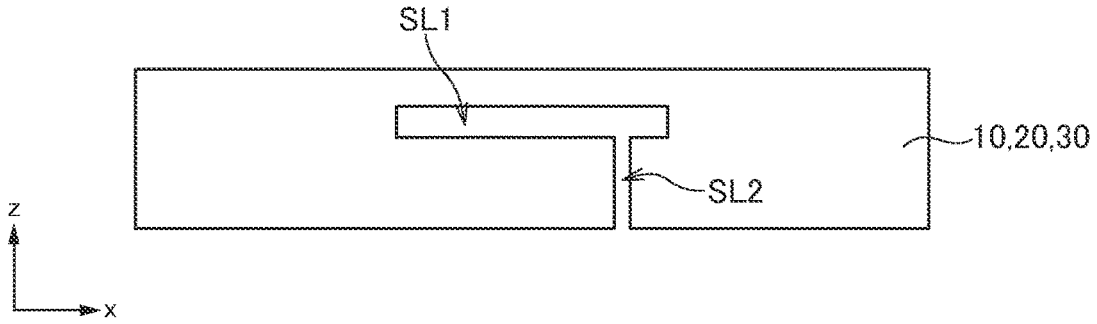
FIG. 16 is a schematic view illustrating an example in which a slit SL2 overlaps a slit SL1 at a position away from an end portion of the slit SL1 in the x-direction.
Figure 17:
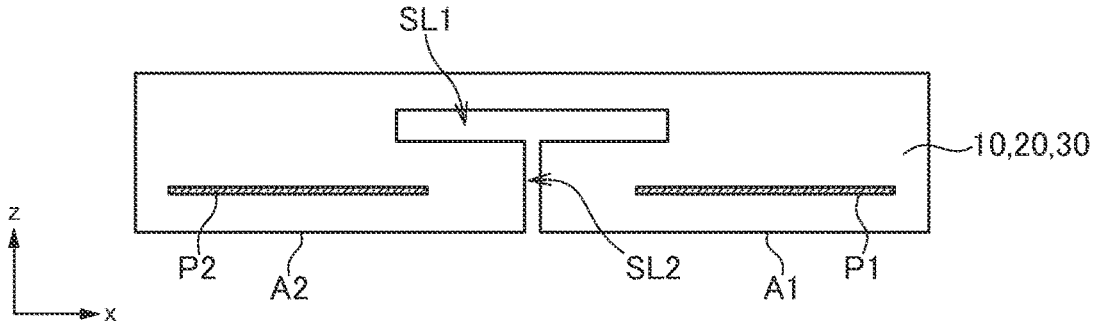
FIG. 17 is a schematic view illustrating an example in which the slit SL2 overlaps the slit SL1 at the center of the slit SL1 in the x-direction.

Although the slit SL2 overlaps an end portion of the slit SL1 in the x-direction in the example of FIG. 1, it may overlap the slit SL1 at a position away from the end portion of the slit SL1 in the x-direction (FIG. 16) or at the center portion of the slit SL1 in the x-direction (FIG. 17). In the latter case, both the antenna conductor P1 provided in the antenna area A1 and the antenna conductor P2 provided in the antenna area A2 may overlap the slit SL1.

While the preferred embodiments of the present disclosure have been described above, the present disclosure is not limited to the above embodiments, and various modifications may be made within the scope of the present disclosure, and all such modifications are included in the present disclosure.

An antenna device according to the present disclosure includes an antenna layer having a plurality of antenna conductors and a first wiring layer stacked on the antenna layer and having a plurality of wiring patterns. The antenna layer has first and second antenna areas which are obtained by dividing, by a slit extending in a first planar direction perpendicular to the stacking direction, the antenna layer in a second planar direction perpendicular to the stacking direction and first planar direction. The slit is enlarged in width in the second planar direction at its bottom contacting the first wiring layer. The plurality of antenna conductors include a first antenna conductor formed in the first antenna area and a second antenna conductor formed in the second antenna area.

According to the present disclosure, folding the first wiring layer along the slit allows the first and second antenna conductors to be directed in mutually different directions. Thus, when the antenna device is mounted in a communication device with the first wiring layer folded, beams can be emitted in a plurality of directions. In addition, the width of the slit is selectively enlarged at is bottom, making it possible to increase the use efficiency of the antenna layer and to suppress increase in the height of the entire antenna device when being folded.

The antenna device according to the present disclosure may further include a second wiring layer positioned between the antenna layer and the first wiring layer in the stacking direction. The slit may include a first slit formed in the second wiring layer and a second slit formed in the antenna layer. The second wiring layer may be divided in the second planar direction by the first slit. The antenna layer may be divided into the first and second antenna areas by the second slit. The first and second slits may overlap each other in the stacking direction. The width of the first slit in the second planar direction may be larger than the width of the second slit in the second planar direction. With the above configuration, it is possible to form more wiring patterns.

In the present disclosure, at least one of the first and second antenna conductors may overlap the first slit in the stacking direction. This can increase the use efficiency of the antenna layer and further suppress increase in the height of the entire antenna device when being folded.

The antenna device according to the present disclosure may further include a semiconductor IC mounted on the surface of the first wiring layer. This allows an antenna module to be constituted. In this case, the plurality of wiring patterns may include a power supply pattern and a control signal pattern which are connected to the semiconductor IC, and the second wiring layer may include an RF signal pattern connected to the first and second antenna conductors.

A manufacturing method for an antenna device according to the present disclosure includes a first step of stacking an antenna layer including first and second antenna conductors and a first wiring layer including a plurality of wiring patterns so as to form a first slit inside extending in a first planar direction perpendicular to the stacking direction and a second step of dividing the antenna layer into a first antenna area including the first antenna conductor and a second antenna area including the second antenna conductor by forming, in the antenna layer, a second slit overlapping the first slit in the stacking direction, the width of the second slit in a second planar direction being smaller than the width of the first slit in the second planar direction.

According to the present disclosure, it is possible to easily manufacture an antenna device having a slit whose width is selectively enlarged at its bottom.

In the present disclosure, the first step may be carried out by interposing a second wiring layer which is divided in the second planar direction by the first slit between the antenna layer and the first wiring layer. This allows more wiring patterns to be formed.

In the first step, the second wiring layer may be interposed between the antenna layer and the first wiring layer in a state where a filler is filled in the first slit. This allows the stacking to be performed while maintaining flatness. In this case, the manufacturing method may further include a third step of removing the filler through the second slit. This allows the first slit to be hollow.

Thus, according to the present disclosure, there can be provided an antenna device capable of emitting beams in a plurality of directions, in which the use efficiency of a substrate constituting the antenna device is improved, and the height of the entire antenna device when it is being folded is minimized and a communication device having such an antenna device. Further, according to the present disclosure, there can be provided a manufacturing method for such an antenna device.

What is claimed is:

1. An antenna device comprising:

an antenna layer having a plurality of antenna conductors; and a first wiring layer stacked on the antenna layer and having a plurality of wiring patterns, wherein the antenna layer has first and second antenna areas which are obtained by dividing, by a slit extending in a first planar direction perpendicular to the stacking direction, the antenna layer in a second planar direction perpendicular to the stacking direction and first planar direction, wherein the slit is enlarged in width in the second planar direction at its bottom contacting the first wiring layer, and wherein the plurality of antenna conductors include a first antenna conductor formed in the first antenna area and a second antenna conductor formed in the second antenna area.

2. The antenna device as claimed in claim 1, further comprising a second wiring layer positioned between the antenna layer and the first wiring layer in the stacking direction, wherein the slit includes a first slit formed in the second wiring layer and a second slit formed in the antenna layer, wherein the second wiring layer is divided in the second planar direction by the first slit, wherein the antenna layer is divided into the first and second antenna areas by the second slit, wherein the first and second slits overlap each other in the stacking direction, and wherein a width of the first slit in the second planar direction is larger than a width of the second slit in the second planar direction.

3. The antenna device as claimed in claim 2, wherein at least one of the first and second antenna conductors overlap the first slit in the stacking direction.

4. The antenna device as claimed in claim 2, further comprising a semiconductor IC mounted on a surface of the first wiring layer.

5. The antenna device as claimed in claim 4, wherein the plurality of wiring patterns include a power supply pattern and a control signal pattern which are connected to the semiconductor IC.

6. The antenna device as claimed in claim 4, wherein the second wiring layer includes an RF signal pattern connected to the first and second antenna conductors.

7. The antenna device as claimed in claim 1, wherein the first wiring layer is folded along the slit.

8. A communication device comprising the antenna device as claimed in claim 7.

9. A method for manufacturing an antenna device, the method comprising:

a first step of stacking an antenna layer including first and second antenna conductors and a first wiring layer including a plurality of wiring patterns so as to form a first slit inside extending in a first planar direction perpendicular to the stacking direction; and a second step of dividing the antenna layer into a first antenna area including the first antenna conductor and a second antenna area including the second antenna conductor by forming, in the antenna layer, a second slit overlapping the first slit in the stacking direction, a width of the second slit in a second planar direction being smaller than a width of the first slit in the second planar direction.

10. The method for manufacturing an antenna device as claimed in claim 9, wherein the first step is carried out by interposing a second wiring layer which is divided in the second planar direction by the first slit between the antenna layer and the first wiring layer.

11. The method for manufacturing an antenna device as claimed in claim 10, wherein, in the first step, the second wiring layer is interposed between the antenna layer and the first wiring layer in a state where a filler is filled in the first slit.

12. The method for manufacturing an antenna device as claimed in claim 11, further comprising a third step of removing the filler through the second slit.

* * * * *